US009475604B2

(12) United States Patent
Smith

(10) Patent No.: US 9,475,604 B2
(45) **Date of Patent: *Oct. 25, 2016**

(54) POLYGONAL CONTAINER AND BLANK FOR MAKING THE SAME

(71) Applicant: WestRock Shared Services, LLC, Norcross, GA (US)

(72) Inventor: Kenneth Charles Smith, Hiram, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/790,730

(22) Filed: Jul. 2, 2015

(65) Prior Publication Data

US 2015/0307224 A1 Oct. 29, 2015

Related U.S. Application Data

(63) Continuation of application No. 14/318,164, filed on Jun. 27, 2014, now Pat. No. 9,073,661, which is a continuation of application No. 12/264,664, filed on Nov. 4, 2008, now Pat. No. 8,777,093.

(60) Provisional application No. 61/048,871, filed on Apr. 29, 2008.

(51) Int. Cl.

| | |
|---|---|
| ***B65D 5/18*** | (2006.01) |
| ***B65D 5/28*** | (2006.01) |
| ***B65D 71/36*** | (2006.01) |

(Continued)

(52) U.S. Cl.

CPC . *B65D 5/18* (2013.01); *B31B 1/26* (2013.01); *B31B 1/78* (2013.01); *B65D 5/28* (2013.01); *B65D 5/48018* (2013.01); *B65D 71/36* (2013.01); *B31B 2201/26* (2013.01); *B65D 2571/0066* (2013.01); *B65D 2571/0079* (2013.01); *B65D 2571/00141* (2013.01);

(Continued)

(58) Field of Classification Search

CPC .... B65D 5/28; B65D 5/48018; B65D 71/36; B65D 2571/0079; B65D 2571/00141; B65D 2571/00718; B65D 2571/00895; B65D 2571/0066; B65D 2571/00839; B65D 5/18; B31B 1/78

USPC ..... 229/109, 110, 194, 915, 918, 919

See application file for complete search history.

(56) References Cited

U.S. PATENT DOCUMENTS 1,892,715 A * 1/1933 Wellman ..... B65D 5/02 229/109

2,347,422 A 4/1944 Loth (Continued)

OTHER PUBLICATIONS

Canadian Office Action, dated Nov. 20, 2014, for co-pending Canadian patent application No. 2,663,727 (3 pgs).

*Primary Examiner* — Gary Elkins

(74) *Attorney, Agent, or Firm* — WestRock IP Legal

(57) ABSTRACT

A blank of sheet material for forming a container is provided. The blank includes a series of four generally rectangular panels connected along a plurality of substantially parallel fold lines. The panels include a first spaced-apart pair of panels and a second spaced-apart pair of panels. Each of the second spaced-apart pair of panels is connected to at least one panel of the first spaced-apart pair of panels. The blank also includes a corner panel extending from each side edge of each panel of the first pair of panels, and a lateral flap extending from each side edge of each panel of the second pair of panels, wherein each lateral flap has free side edges.

21 Claims, 9 Drawing Sheets

(51) Int. Cl.
*B31B 1/78* (2006.01)
*B65D 5/48* (2006.01)
*B31B 1/26* (2006.01)

(52) U.S. Cl.
CPC ..... *B65D2571/00728* (2013.01); *B65D 2571/00839* (2013.01); *B65D 2571/00895* (2013.01)

(56) References Cited

U.S. PATENT DOCUMENTS 2,372,312 A 3/1945 Buttery
2,645,405 A 7/1953 Dorfman
2,705,556 A 4/1955 Ringler
2,751,075 A 6/1956 Arneson
2,899,123 A 8/1959 Currie, Jr.
3,265,285 A * 8/1966 Fanter ..... B65D 5/5435 229/151
3,512,697 A 5/1970 Robinson
3,807,624 A 4/1974 Funkhouser
3,825,170 A 7/1974 Aust et al.
3,923,234 A 12/1975 Lund, Jr.
3,973,723 A * 8/1976 Owens ..... B65D 5/6632 229/143
3,979,882 A 9/1976 Howe
4,067,442 A 1/1978 Howe
4,308,020 A 12/1981 Langen
4,676,429 A * 6/1987 Crowe ..... B65D 5/2033 229/109
4,792,084 A 12/1988 Dreeszen
4,793,546 A 12/1988 Nunn
5,295,623 A 3/1994 Bacques et al.
5,350,109 A 9/1994 Brown et al.
5,395,043 A 3/1995 Bacques et al.
5,531,374 A 7/1996 Gasper
5,613,694 A 3/1997 Gasper
5,669,500 A 9/1997 Sutherland
5,715,991 A 2/1998 Gasper
D394,386 S 5/1998 Fischer
5,816,483 A 10/1998 Gasper
5,915,617 A 6/1999 Gasper
5,921,465 A 7/1999 Garton
6,012,629 A 1/2000 Newcomer
6,085,969 A 7/2000 Burgoyne
6,158,652 A * 12/2000 Ruiz ..... B65D 5/003 229/177
6,290,123 B1 9/2001 Pei
6,364,200 B1 4/2002 Moss et al.
6,371,363 B1 4/2002 Franklin et al.
6,591,587 B2 7/2003 Salm et al.
7,090,115 B2 8/2006 Pierce
7,316,103 B2 1/2008 Ford
7,485,083 B2 2/2009 Gaeta
9,073,661 B2 * 7/2015 Smith ..... B65D 71/36
2005/0145684 A1 * 7/2005 Gaeta ..... B65D 5/2033 229/109
2006/0081691 A1 4/2006 Smalley
2006/0169755 A1 8/2006 Spivey, Sr.
2006/0278689 A1 12/2006 Boshinski et al.
2007/0000984 A1 * 1/2007 McClure ..... B65D 5/6632 229/143
2007/0051789 A1 * 3/2007 Panduro, Jr. ..... B65D 5/6629 229/175
2010/0001052 A1 * 1/2010 Gardner ..... B65D 5/28 229/109
2010/0163609 A1 * 7/2010 Bull ..... B65D 71/36 229/109

* cited by examiner

POLYGONAL CONTAINER AND BLANK FOR MAKING THE SAME

CROSS REFERENCE TO RELATED APPLICATIONS

This application is a continuation application of U.S. patent application Ser. No. 14/318,164, filed Jun. 27, 2014, entitled "POLYGONAL CONTAINER AND BLANK FOR MAKING THE SAME," which is a continuation application of U.S. patent application Ser. No. 12/264,664, filed Nov. 4, 2008, entitled "POLYGONAL CONTAINER AND BLANK FOR MAKING THE SAME," which claims the priority of Provisional Patent Application Ser. No. 61/048,871, filed Apr. 29, 2008, the disclosures of each of which are hereby incorporated by reference in their entireties.

BACKGROUND OF THE INVENTION

The field of the invention relates generally to a blank and a polygonal container formed from the blank and more particularly, to a blank that may be formed into a polygonal container about a product to be contained therein.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank is formed into a container about a product to be contained therein. One known container, as described in U.S. Pat. Nos. 5,295,623 and 5,395,043, is formed from a blank that includes a sequence of at least four panels connected to one another via fold lines and having lateral flaps connected respectively to each panel via fold lines that are perpendicular to the fold lines interconnecting the panels. At least two of the panels are a first spaced-apart pair that each have cut-off corners. Each of the cut-off corners has at least one edge, and the pair of panels are the bottom and the top of the container. Lateral tongues extend from the side edges of the lateral flaps of the first pair of panels. The panels between the first pair of panels constitute a second spaced-apart pair that each have first and second lateral flaps extending from side edges thereof.

The first lateral flaps include cut-off corners adjacent a respective second lateral flaps. As such, each first lateral flap has a first width at top and bottom edges that is narrower than a second width near the center portion of each first lateral flap and has a first height adjacent one of the panels and a second height adjacent a respective second lateral flap, wherein the first height is larger than the second height. Accordingly, the height of each first lateral flap decreases from an adjacent panel toward a respective second lateral flap. Each second lateral flap is coupled to a first lateral flap where the first lateral flap has the second width and the second height. Each second lateral flap includes a free edge opposing a respective first lateral flap. The second pair of panels are connected to the first pair of panels at fold lines that are parallel to the fold lines of the first pair. After being folded, each tongue of the first pair of panels is secured to a respective first lateral flap of the second pair of panels. The blank includes twenty-four fold lines and twenty-five panels.

The container described in the '623 and the '043 patents includes tongues that are folded and secured to corner walls formed by the first lateral flaps. Accordingly, a need exists for an eight-sided container for wrapping around a product that includes fewer fold lines and/or panels than known eight-sided containers while also providing improved stacking strength.

BRIEF DESCRIPTION OF THE INVENTION

In one aspect, a blank of sheet material for forming a container is provided. The blank includes a series of four generally rectangular panels connected along a plurality of substantially parallel fold lines. The panels include a first spaced-apart pair of panels and a second spaced-apart pair of panels. Each of the second spaced-apart pair of panels is connected to at least one panel of the first spaced-apart pair of panels. The blank also includes a corner panel extending from each side edge of each panel of the first pair of panels, and a lateral flap extending from each side edge of each panel of the second pair of panels, wherein each lateral flap has free side edges.

In another aspect, a container formed from a blank of sheet material is provided. The container includes a bottom wall, a pair of end walls, a pair of side walls and at least one corner wall interconnected along a plurality of fold lines. The at least one corner wall extends between an adjacent end wall and side wall. Each side wall includes a bottom side flap that does not overlap the at least one corner wall.

In still another aspect, a method of forming a container from a blank of sheet material is provided. The blank includes a series of four generally rectangular panels connected along a plurality of substantially parallel fold lines. The panels define a first spaced-apart pair of panels, and a second spaced-apart pair of panels, wherein each of the second spaced-apart pair of panels is connected to at least one panel of said first spaced-apart pair of panels. A corner panel extends from each side edge of each panel of the first pair of panels. A side panel extends from each corner panel, and a lateral flap extends from each side edge of each panel of the second pair of panels. Each lateral flap having free side edges. The method includes rotating the panels of the first pair of panels about respective fold lines toward a first panel of the second pair of panels to form a pair of opposing end walls and a bottom wall, rotating the corner panels about respective fold lines toward an adjacent panel of the first pair of panels to form a plurality of corner walls, rotating the side panels about respective fold lines toward an adjacent corner panel, rotating the lateral flaps about respective fold lines toward at least one side panel, without overlapping the corner panels, to form a pair of opposing side walls, wherein the end walls, side walls, and bottom wall define a cavity, and securing each of the lateral flaps to at least one of the side panels.

In still another aspect, a blank of sheet material for forming a container having a cavity is provided. The blank includes a first end panel, a second end panel, a bottom panel and at least one top panel connected along a plurality of substantially parallel fold lines, a pair of lateral flaps extending from opposing sides of the bottom panel, a corner panel extending from each side edge of each end panel, and first and second side panels extending from each side edge of each corner panel. Each of the second side panels has a free edge. The free edges of the second side panels of the first end panel are configured to interconnect with the free edges of the second side panels of the second end panel.

In still another aspect, a container formed from a blank of sheet material is provided. The container includes a bottom wall, a pair of end walls, a pair of side walls and at least one corner wall interconnected along a plurality of fold lines. The at least one corner wall extending between an adjacent end wall and side wall. The walls defining a cavity. Each side wall including a pair of side panels and a pair of joinder panels. Each joinder panel having a free edge. The free edge of one joinder panel of each pair of joinder panels is configured to interconnect with the other joinder panel of each pair of joinder panels. Each pair of joinder panels extend from the side panels inwardly toward the cavity.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, collapsible container that may be formed about a product to be contained therein, and a method for constructing the container. The container may be constructed from a blank of sheet material using a machine. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

Figure 1:
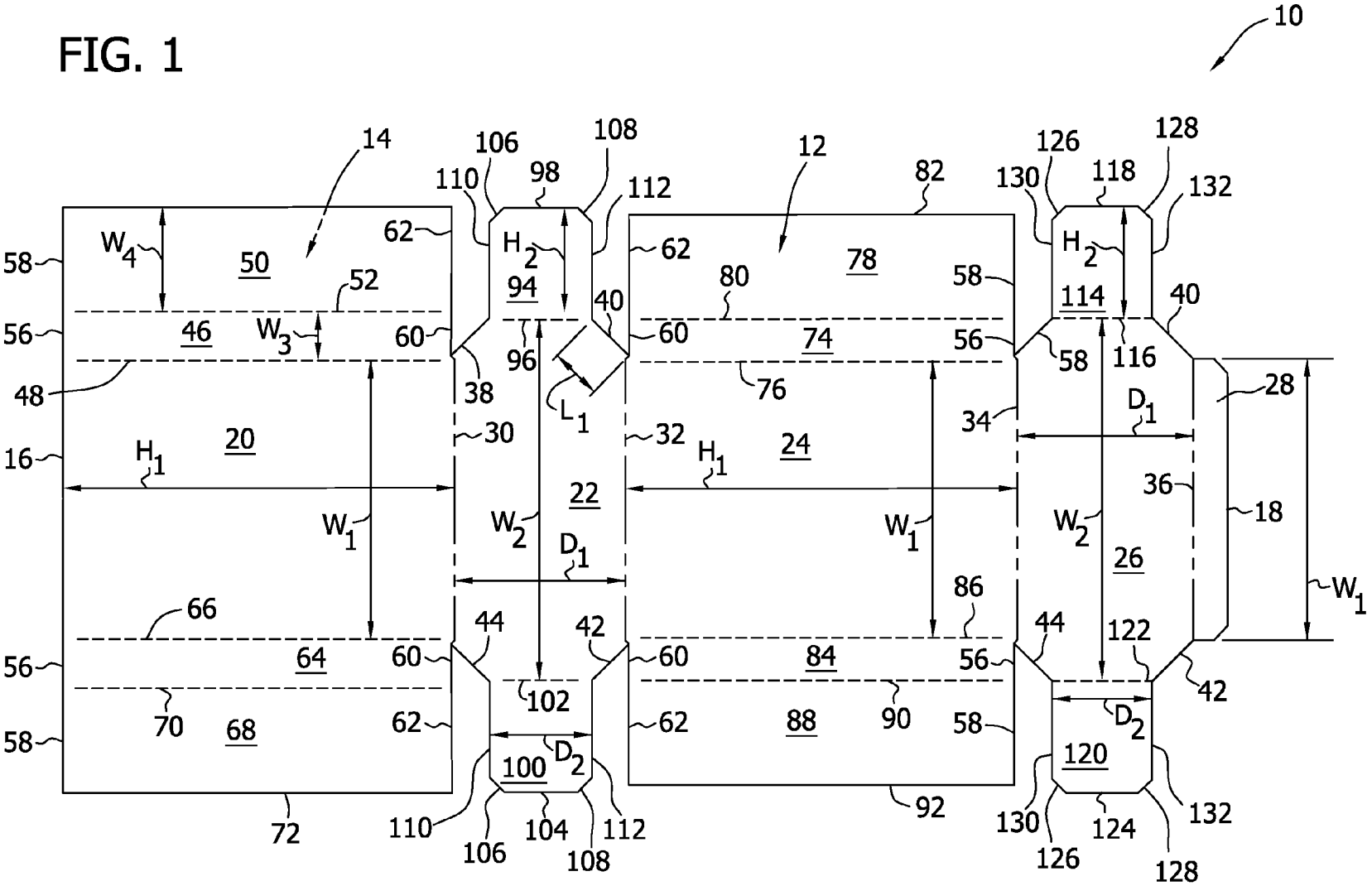
FIG. 1 is a top plan view of a blank of sheet material for constructing a container, according to a first embodiment of the present invention.

Referring now to the drawings, and more specifically to FIG. 1, which is a top plan view of a first embodiment of a blank 10 of sheet material. A container 200 (shown in FIGS. 2 and 3) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a front panel 20, a bottom panel 22, a rear panel 24, a top panel 26, and a front flap, or closure flap, 28 coupled together along preformed, generally parallel, fold lines 30, 32, 34, and 36, respectively. More specifically, front panel 20 extends between leading edge 16 and fold line 30, bottom panel 22 extends from front panel 20 along fold line 30, rear panel 24 extends from bottom panel 22 along fold line 32, top panel 26 extends from rear panel 24 along fold line 34, and front flap 28 extends from top panel 26 along fold line 36 to trailing edge 18. Fold lines 30, 32, 34, and/or 36, as well as other fold lines and/or hinge lines described herein, may include any suitable line of weakening and/or line of separation known to those skilled in the art and guided by the teachings herein provided. Front and rear panels 20 and 24 may be considered to be end panels. When container 200 is formed from blank 10, fold line 30 defines a bottom edge of front panel 20 and a front edge of bottom panel 22, fold line 32 defines a rear edge of bottom panel 22 and a bottom edge of rear panel 24, fold line 34 defines a top edge of rear panel 24 and a rear edge of top panel 26, and fold line 36 defines a front edge of top panel 26 and a top edge of front flap 28.

Front panel 20 and rear panel 24 are substantially congruent and have a rectangular shape. Similarly, bottom panel 22 and top panel 26 are substantially congruent and have an octagonal shape. More specifically, front panel 20, rear panel 24, and front flap 28 have a width $W_1$. Bottom and top panels 22 and 26 have a width $W_2$, which is longer than width $W_1$. Alternatively, width $W_1$ is substantially equal to or longer than width $W_2$. Further, in the exemplary embodiment, front and rear panels 20 and 24 have a first height $H_1$, and bottom and top panels 22 and 26 have a first depth $D_1$ that is smaller than first height $H_1$. In an alternative embodiment, height $H_1$ is substantially equal to or smaller than depth $D_1$. In the exemplary embodiment, front panel 20 and/or rear panel 24 and/or bottom panel 22 and/or top panel 26 are equally dimensioned, however, front panel 20 and/or rear panel 24 and/or bottom panel 22 and/or top panel 26 may be other than equally dimensioned.

In the exemplary embodiment, bottom panel 22 and top panel 26 may each be considered to be substantially rectangular in shape with four cut-off corners or angled edges 38, 40, 42, and 44. As such, the cut-off corners of otherwise rectangular bottom and top panels 22 and 26 define an octagonal shape of bottom and top panels 22 and 26. Moreover, each angled corner 38, 40, 42, and 44 has a length $L_1$, and angled corners 38 and 42 and angled corners 40 and 44 are substantially parallel. Alternatively, bottom panel 22 and/or top panel 26 has any suitable shape that enables container 200 to function as described herein. For example, bottom panel 22 and/or top panel 26 may be in the shape of a rectangle having corners that are truncated by a segmented edge such that bottom panel 22 and/or top panel 26 has more than eight sides. In another example, bottom panel 22 and/or top panel 26 may be in the shape of a rectangle having corners that are truncated by an arcuate edge such that bottom panel 22 and/or top panel 26 has four substantially straight sides and four arcuate sides.

A first corner panel 46 extends from front panel 20 along a fold line 48, and a first side panel 50 extends from first corner panel 46 along a fold line 52 to a free edge 54. Fold lines 48 and 52 define side edges of first corner panel 46, fold line 48 defines a side edge of front panel 20, and fold line 52 defines a side edge of first side panel 50. First corner panel 46 and first side panel 50 are each substantially rectangular shaped having a respective top edge 56 or 58 and a respective bottom edge 60 or 62. First corner panel 46 and first side panel 50 each have substantially height $H_1$ such that front panel 20, first corner panel 46, and first side panel 50 have a substantially equal height. As such, top edges 56 and 58 are substantially collinear with leading edge 16, which defines a top edge of front panel 20, and bottom edges 60 and 62 are substantially collinear with fold line 30. Further, first corner panel 46 has a width $W_3$, and first side panel 50 has a width $W_4$. Width $W_3$ is substantially equal to length $L_1$, and width $W_4$ is longer than width $W_3$. Alternatively, width $W_3$ is equal to or longer than width $W_4$. In the exemplary embodiment, first corner panel 46 has substantially constant width $W_3$ from top edge 56 to bottom edge 60 such that first corner panel 46 does not include cut-off corners and/or tapered top and/or bottom edges.

Similarly, a second corner panel 64 extends from front panel 20 along a fold line 66, a second side panel 68 extends from second corner panel 64 along a fold line 70 to a free edge 72, a third corner panel 74 extends from rear panel 24 along a fold line 76, a third side panel 78 extends from third corner panel 74 along a fold line 80 to a free edge 82, a fourth corner panel 84 extends from rear panel 24 along a fold line 86, and a fourth side panel 88 extends from fourth corner panel 84 along a fold line 90 to a free edge 92. In the exemplary embodiment, second corner panel 64, second side panel 68, third corner panel 74, third side panel 78, fourth corner panel 84, and fourth side panel 88 are each substantially rectangular and have substantially height $H_1$ extending between respective top edges 56 or 58 and respective bottom edges 60 or 62 such that front panel 20, rear panel 24, corner panels 64, 74, and 84, and side panels 68, 78, and 88 have an equal height. As such, top edges 56 and 58 of second corner and side panels 64 and 68 are substantially collinear with leading edge 16, bottom edges 60 and 62 of second corner and side panels 64 and 68 are substantially collinear with fold line 30, top edges 56 and 58 of third corner and side panels 74 and 78 are substantially collinear with fold line 34, bottom edges 60 and 62 of third corner and side panels 74 and 78 are substantially collinear with fold line 32, top edges 56 and 58 of fourth corner and side panels 84 and 88 are substantially collinear with fold line 34, and bottom edges 60 and 62 of fourth corner and side panels 84 and 88 are substantially collinear with fold line 32.

Further, second corner panel 64, third corner panel 74, and fourth corner panel 84 have width $W_3$, and second side panel 68, third side panel 78, and fourth side panel 88 have width $W_4$. Alternatively, corner panels 46, 64, 74, and/or 84 and/or side panels 50, 68, 78, and/or 88 may have any suitable dimensions that enable blank 10 to function as described herein. In the exemplary embodiment, corner panels 64, 74, and 84 have substantially constant width $W_3$ from top edges 56 to bottom edges 60 such that corner panels 64, 74, and 84 do not include cut-off corners and/or tapered top and/or bottom edges. Further, second, third, and fourth corner panels 64, 74, and 84 are substantially congruent to first corner panel 46, and second, third, and fourth side panels 68, 78, and 88 are substantially congruent to first side panel 50. Alternatively, corner panels 46, 64, 74, and/or 84 are other than congruent to each other and/or side panels 50, 68, 78, and/or 88 are other than congruent to each other. For example, first and second side panels 50 and 68 are congruent, and third and fourth side panels 78 and 88 are congruent with each other but not first and/or second side panels 50 and/or 68.

In the exemplary embodiment, fold line 48 is generally aligned with an intersection of angled corner 38 of bottom panel 22 and fold line 30, fold line 66 is substantially aligned with an intersection of angled corner 44 of bottom panel 22 and fold line 30, fold line 76 is substantially aligned with and extends between the intersections of angled corner 40 of bottom panel 22 and fold line 32 and angled corner 38 of top panel 26 and fold line 34, and fold line 86 is substantially aligned with and extends between the intersections of angled corner 42 of bottom panel 22 and fold line 32 and angled corner 44 of top panel 26 and fold line 34. Further, fold lines 48, 52, 66, 70, 76, 80, 86, and 90 are substantially parallel. Moreover, free edges 54, 72, 82, and 92 are substantially parallel with fold lines 48, 52, 66, 70, 76, 80, 86, and 90. Alternatively, free edges 54, 72, 82, and/or 92 and/or fold lines 48, 52, 66, 70, 76, 80, 86, and/or 90 are other than parallel.

A first bottom side panel 94 extends from bottom panel 22 along a fold line 96 to a free edge 98, and a second bottom side panel 100 extends from bottom panel 22 along a fold line 102 to a free edge 104. Fold line 96 defines a bottom edge of first bottom side panel 94 and a side edge of bottom panel 22, and fold line 102 defines a bottom edge of second bottom side panel 100 and a side edge of bottom panel 22. First and second bottom side panels 94 and 100 are each generally rectangularly shaped and have angled corners 106 and 108 and free side edges 110 and 112. Bottom side panels 94 and 100 each have a depth $D_2$ between side edges 110 and 112 that is shorter than depth $D_2$ such that bottom side panels 94 and 100 are narrower than bottom panel 22. In the exemplary embodiment, depth $D_2$ is substantially equal to width $W_4$, however, depth $D_2$ may be less than or greater than width $W_4$ depending on the overlap and/or separation between free edges 54 and 82 of first and third side panels 50 and 78 and/or between free edges 72 and 82 of second and fourth side panels 68 and 88, as described in more detail below. Further, in the exemplary embodiment, bottom side panels 94 and 100 each have a height $H_2$ such that width $W_2$ and height $H_2$ are substantially equal to widths $W_1$, $W_3$, and $W_4$. Alternatively, width $W_2$ and height $H_2$ are other than equal to widths $W_1$, $W_3$, and $W_4$. In the exemplary embodiment, fold line 96 extends between ends of angled corners 38 and 40, and fold line 102 extends between ends of angled corners 42 and 44. Bottom side panels 94 and 100, and top side panels 114 and 120 are also referred to as lateral flaps.

Similarly, a first top side panel 114 extends from top panel 26 along a fold line 116 to a free edge 118, and a second top side panel 120 extends from top panel 26 along a fold line 122 to a free edge 124. Fold line 116 defines a top edge of first top side panel 114 and a side edge of top panel 26, and fold line 122 defines a top edge of second top side panel 120 and a side edge of top panel 26. First and second top side panels 114 and 120 are each generally rectangularly shaped and have angled corners 126 and 128 and free side edges 130 and 132. Top side panels 114 and 120 each have depth $D_2$ between side edges 130 and 132. Further, top side panels 114 and 120 each have height $H_2$. As such, top side panels 114 and 120 are substantially congruent to bottom side panels 94 and 100. Alternatively, top side panels 114 and/or 120 may be other than congruent to bottom side panels 94 and/or 100. In the exemplary embodiment, fold line 116 extends between ends of angled corners 38 and 40, and fold line 122 extends between ends of angled corners 42 and 44.

Figure 2:
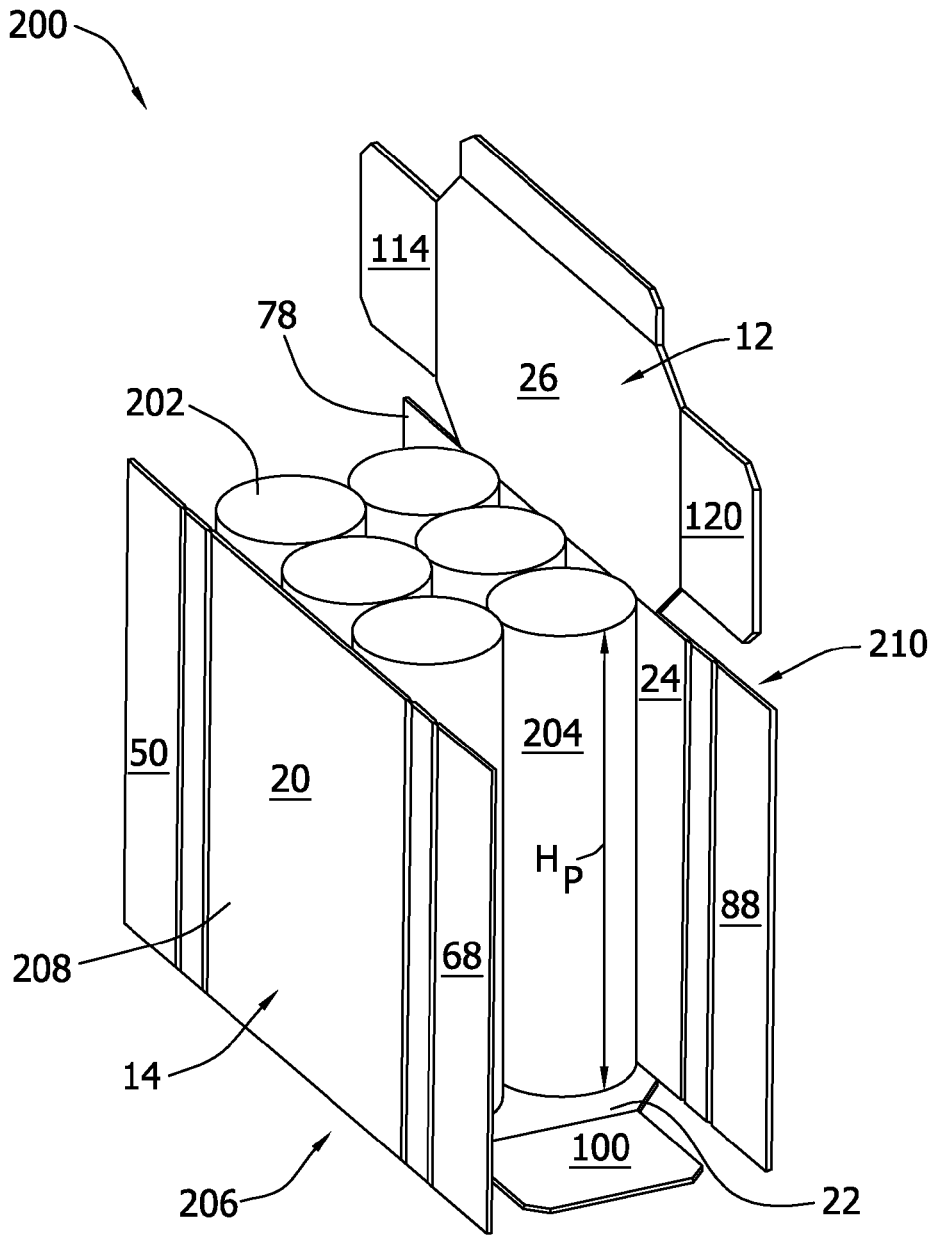
FIG. 2 is a side perspective view of a container that is partially formed from the blank shown in FIG. 1.
Figure 3:
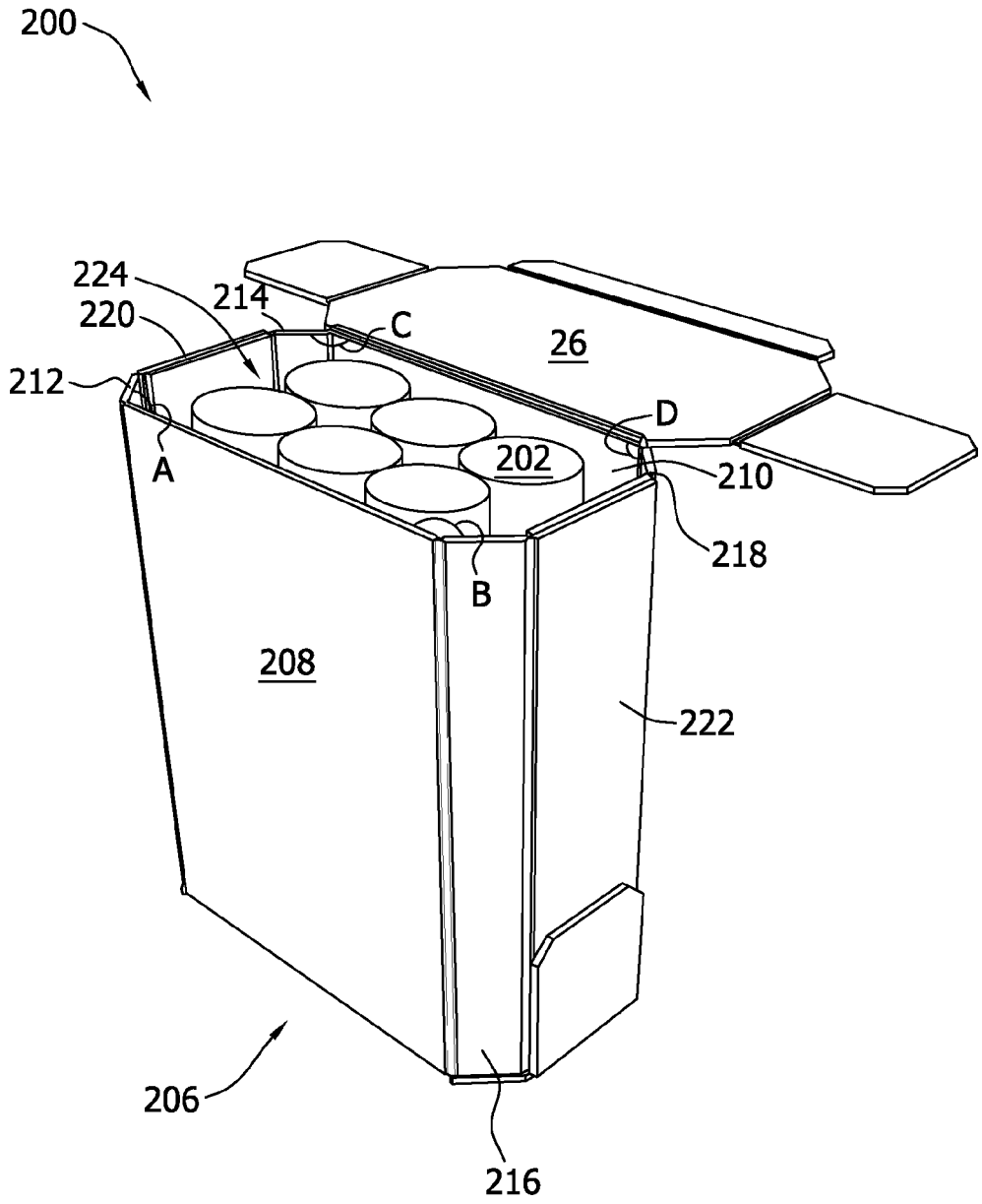
FIG. 3 is a side perspective view of the container formed from the blank shown in FIG. 1.

FIG. 2 is a side perspective view of container 200 that is partially formed from blank 10 and includes products 202 therein. FIG. 3 is a side perspective view of container 200 formed from blank 10 and containing products 202. Although container 200 is shown as being formed about a product 202 to be contained therein, container 200 may be formed without having a product 202 therein. Further, although container 200 includes a plurality of products 202, container 200 may include any suitable number of products 202, such as one product 202. Moreover, although products 202 are shown as cylindrical, products 202 may have any suitable shape.

To construct container 200 from blank 10, at least one product 202 is positioned on interior surface 12 of bottom panel 22. In the exemplary embodiment, bottom panel 22 is sized to correspond to product(s) 202 contained within container 200. Front panel 20 is rotated about fold line 30 toward interior surface 12 and/or products 202, and rear panel 24 is rotated about fold line 32 toward interior surface 12 and/or products 202. More specifically, front panel 20 and rear panel 24 are rotated to be substantially perpendicular to bottom panel 22, as shown in FIG. 2. When container 200 is formed about products 202, interior surface 12 of front and rear panels 20 and 24 is adjacent side walls 204 of products 202. Further, height $H_1$ of front and rear panels 20 and 24 is sized to correspond to a height Hp of products 202 such that height $H_1$ is substantially equal to or greater than height Hp. Bottom panel 22 forms a bottom wall 206 of container, front panel 20 forms a front wall 208 of container 200, and rear panel 24 forms a rear wall 210 of container 200.

First corner panel 46 is rotated about fold line 48 toward interior surface 12 and/or products 202, and first side panel 50 is rotated about fold line 52 toward interior surface 12 and/or products 202. More specifically, first corner panel 46 and first side panel 50 are rotated such that first corner panel 46 is oriented at an oblique angle A to front panel 20 and first side panel 50 is substantially perpendicular to front panel 20 and bottom panel 22. Similarly, second corner panel 64 is rotated about fold line 66 toward interior surface 12 and/or products 202, and second side panel 68 is rotated about fold line 70 toward interior surface 12 and/or products 202. More specifically, second corner panel 64 and second side panel 68 are rotated such that second corner panel 64 is oriented at an oblique angle B to front panel 20 and second side panel 68 is substantially perpendicular to front panel 20 and bottom panel 22. In the exemplary embodiment, angles A and B are substantially equal, however, angles A and B can be other than equal depending upon products 202 contained within container 200. Further, in the exemplary embodiment, first and second side panels 50 and 68 are substantially parallel.

Figure 5:
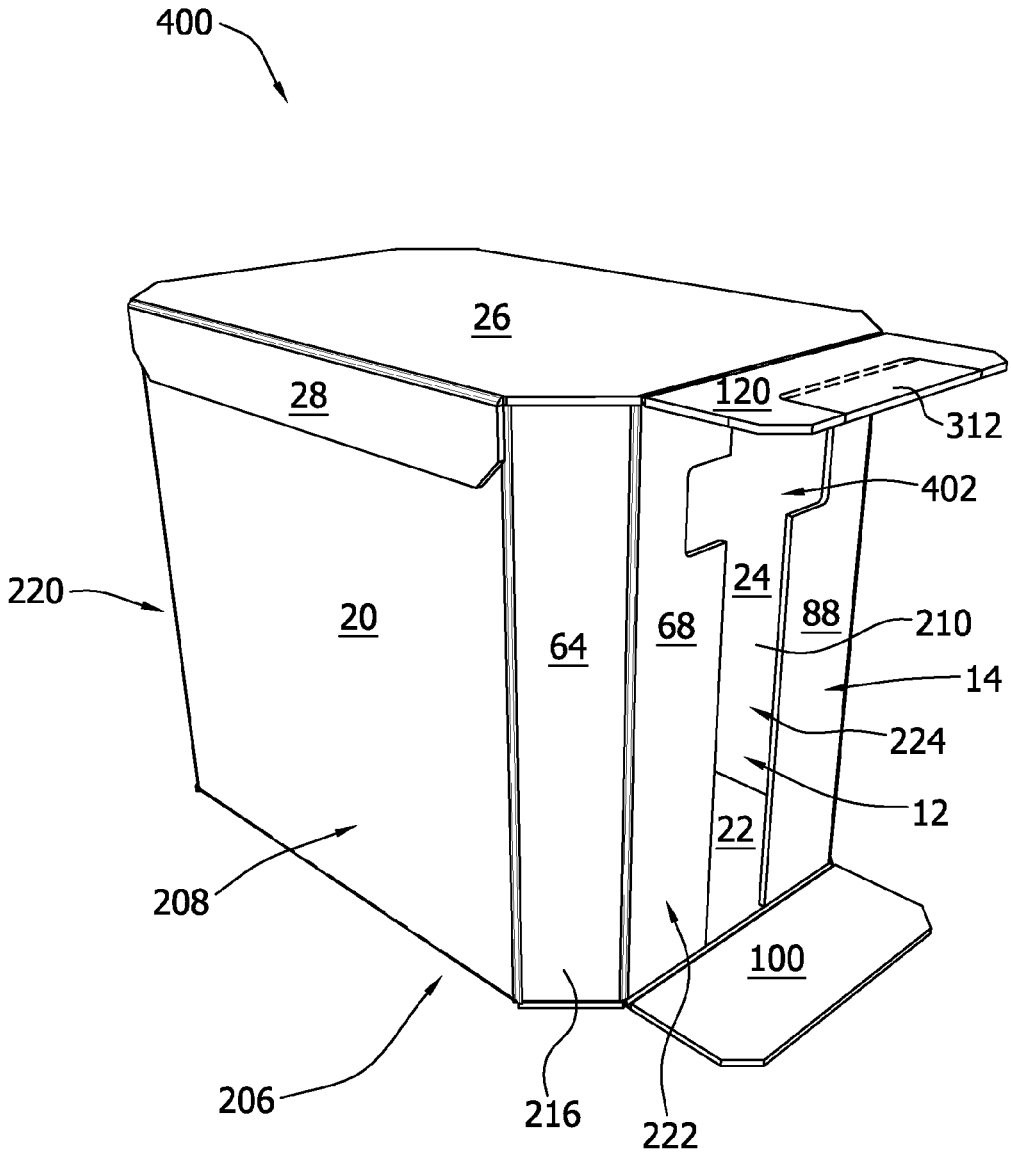
FIG. 5 is a side perspective view of a container formed from the blank shown in FIG. 4.

Third corner panel 74 is rotated about fold line 76 toward interior surface 12 and/or products 202, and third side panel 78 is rotated about fold line 80 toward interior surface 12 and/or products 202. More specifically, third corner panel 74 and third side panel 78 are rotated such that third corner panel 74 is oriented at an oblique angle C to rear panel 24 and third side panel 78 is substantially perpendicular to rear panel 24 and bottom panel 22. Interior surface 12 of third side panel 78 is adjacent exterior surface 14 of first side panel 50, and side panels 50 and 78 are secured together using any suitable bonding material, such as glue, tape, and/or adhesives. In the exemplary embodiment, free edge 54 of first side panel 50 is substantially aligned with fold line 80, and free edge 82 of third side panel 78 is substantially aligned with fold line 52. Alternatively, first and third side panels 50 and 78 only partially overlap and/or do not overlap (as shown in FIG. 5) such that free edge 54 is offset from fold line 80 and/or free edge 82 is offset from fold line 52. Further, in the exemplary embodiment, bottom edges 62 of side panels 50 and 78 are substantially aligned with fold line 96, bottom edge 60 of third corner panel 74 is substantially aligned with angled corner 40 of bottom panel 22, and bottom edge 60 of first corner panel 46 is substantially aligned with angled corner 38 of bottom panel 22. First corner panel 46 forms a first corner wall 212 of container 200, and third corner panel 74 forms a third corner wall 214 of container 200.

Fourth corner panel 84 is rotated about fold line 86 toward interior surface 12 and/or products 202, and fourth side panel 88 is rotated about fold line 90 toward interior surface 12 and/or products 202. More specifically, fourth corner panel 84 and fourth side panel 88 are rotated such that fourth corner panel 84 is oriented at an oblique angle D to rear panel 24 and fourth side panel 88 is substantially perpendicular to rear panel 24 and bottom panel 22. In the exemplary embodiment, angles A, B, C, and D are substantially equal, however, angles A, B, C, and/or D can be other than equal depending upon products 202 contained within container 200. Further, in the exemplary embodiment, third and fourth side panels 78 and 88 are substantially parallel.

Interior surface 12 of fourth side panel 88 is adjacent exterior surface 14 of second side panel 68, and side panels 68 and 88 are secured together using any suitable bonding material, such as glue, tape, and/or adhesives. In the exemplary embodiment, free edge 72 of second side panel 68 is substantially aligned with fold line 90, and free edge 92 of fourth side panel 88 is substantially aligned with fold line 70. Alternatively, second and fourth side panels 68 and 88 only partially overlap and/or do not overlap such that free edge 72 is offset from fold line 90 and free edge 92 is offset from fold line 70. Further, in the exemplary embodiment, bottom edges 62 of side panels 68 and 88 are substantially aligned with fold line 102, bottom edge 60 of fourth corner panel 84 is substantially aligned with angled corner 42, and bottom edge 60 of second corner panel 64 is substantially aligned with angled corner 44. As such, bottom edges 60 and 62 of corner and side panels 46, 64, 74, 84, 50, 68, 78, and 88 are adjacent to and/or in contact with bottom wall 206. Further, bottom edges 60 and 62 of corner and side panels 46, 64, 74, 84, 50, 68, 78, and 88 are substantially co-planar with bottom wall 206. Second corner panel 64 forms a second corner wall 216 of container 200, and fourth corner panel 84 forms a fourth corner wall 218 of container 200.

Although, as described above and shown in FIG. 3, third and fourth side panels 78 and 88 overlap first and second side panels 50 and 68, respectively, it will be understood that first and second side panels 50 and 68 may overlap third and fourth side panels 78 and 88, respectively.

In the exemplary embodiment, first bottom side panel 94 is rotated about fold line 96 toward exterior surface 14 of third side panel 78, and second bottom side panel 100 is rotated about fold line 102 toward exterior surface 14 of fourth side panel 88. First bottom side panel 94 is secured at least to third side panel 78, and second bottom side panel 100 is secured at least to fourth side panel 88. First side panel 50, third side panel 78, and first bottom side panel 94 form a first side wall 220 of container 200, and second side panel 68, fourth side panel 88, and second bottom side panel 100 form a second side wall 222 of container 200. Bottom wall 206, front wall 208, rear wall 210, corner walls 212, 216, 214, and 218, and side walls 220 and 222 define a cavity 224 of container 200 in which products 202 are contained. Further, when a top wall is not yet formed, container 200 is considered to be in an open configuration.

To close container 200, top panel 26 is rotated about fold line 34 toward cavity 224 such that top panel 26 is substantially perpendicular to rear wall 210 and substantially parallel to bottom wall 206. First top side panel 114 is rotated about fold line 116 toward exterior surface 14 of third side panel 78, and second top side panel 120 is rotated about fold line 122 toward exterior surface 14 of fourth side panel 88. First top side panel 114 is secured to third side panel 78, and second top side panel 120 is secured to fourth side panel 88. First top side panel 114 becomes a part of first side wall 220 when container 200 is in a closed configuration, and second top side panel 120 becomes a part of second side wall 222 when container 200 is in the closed configuration. Top panel 26 forms the top wall of container 200. Front flap 28 is rotated about fold line 36 toward exterior surface 14 of front wall 208 and is secured thereto. Front flap 28 becomes a part of front wall 208 when container 200 is in the closed configuration. Further, when container 200 is in the closed configuration, first corner panel top edge 56 is adjacent angled edge 40 of top panel 26, second corner panel top edge 56 is adjacent angled edge 42 of top panel 26, third corner panel top edge 56 is adjacent angled edge 38 of top panel 26, and fourth corner panel top edge 56 is adjacent angled edge 44 of top panel 26. As such, top edges 56 and 58 of corner and side panels 46, 64, 74, 84, 50, 68, 78, and 88 are adjacent to and/or in contact with top panel 26. Further, top edges 56 and 58 of corner and side panels 46, 64, 74, 84, 50, 68, 78, and 88 are substantially co-planar with top panel 26.

The above-described method to construct container 200 from blank 10 may be performed using a machine. The machine performs the above-described method to continuously form container 200 from blank 10 as blank 10 is moved though the machine. In one embodiment, the machine includes at least one plow or finger to rotate panels 20, 24, 26, 28, 46, 50, 64, 68, 74, 78, 84, 88, 94, 100, 114, and/or 120.

Figure 4:
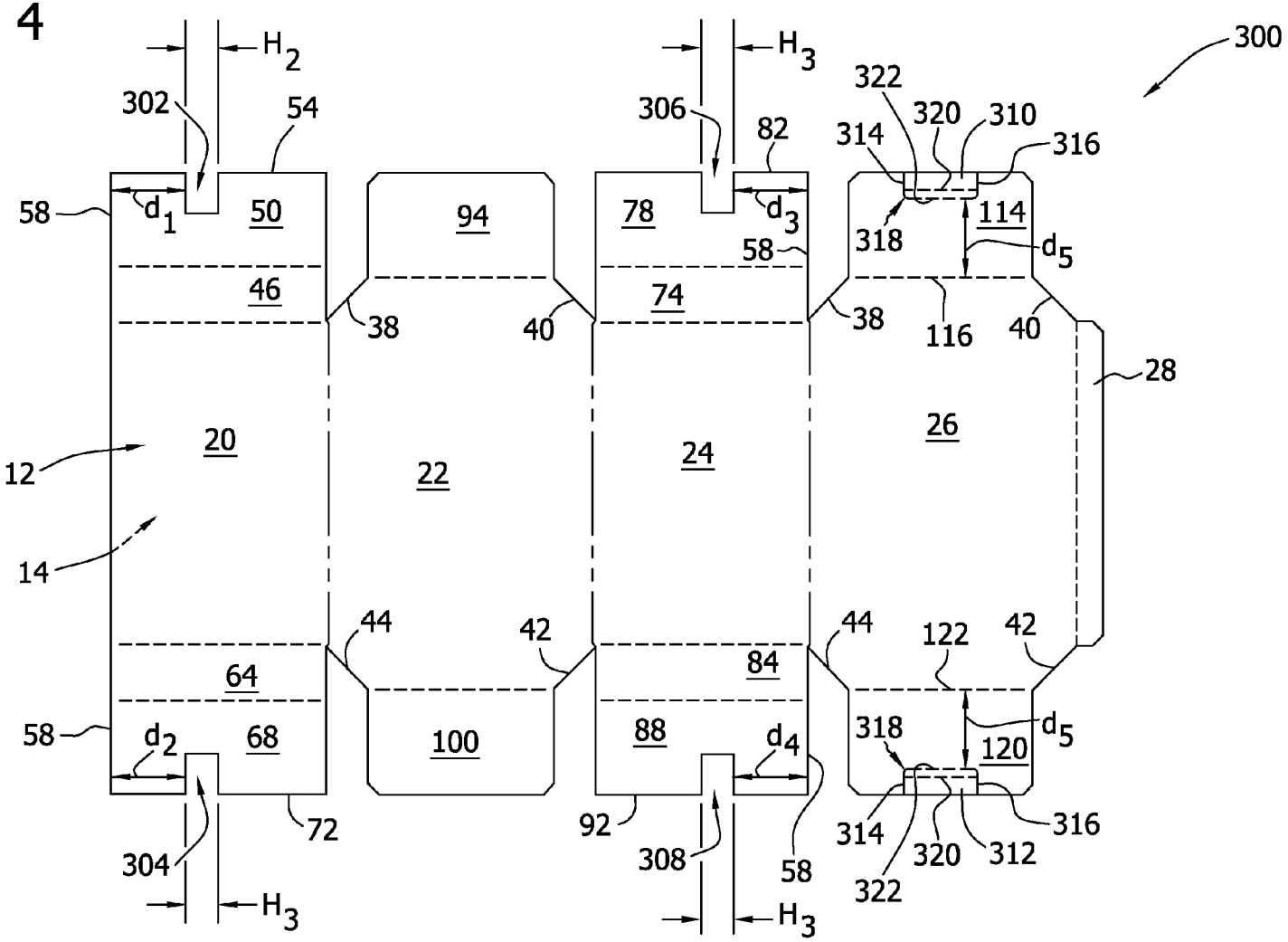
FIG. 4 is a top plan view of a blank of sheet material for constructing a container, according to a first alternative embodiment of the present invention.

FIG. 4 is a top plan view of a first alternative embodiment of a blank 300 of sheet material for constructing a container 400 (shown in FIG. 5). Blank 300 includes several components that are similar to components indicated in blank 10 (shown in FIG. 1) and, as such, similar components are labeled with similar references. More specifically, blank 300 includes side handles, and side panels 50 and 78 and side panels 68 and 88 that do not overlap. Further, blank 300 is sized differently than blank 10 such that the relationships between widths $W_1$, $W_2$, $W_3$, and/or $W_4$, heights $H_1$ and/or $H_2$, depths $D_1$ and/or $D_2$, and/or length $L_1$ are different than the relationships with respect to blank 10.

First side panel 50 includes a first notch 302 defined in free edge 54 at a distance $d_1$ from top edge 58, second side panel 68 includes a second notch 304 defined in free edge 72 at a distance $d_2$ from top edge 58, third side panel 78 includes a third notch 306 defined in free edge 82 at a distance $d_3$ from top edge 58, and fourth side panel 88 includes a fourth notch 308 defined in free edge 92 at a distance $d_4$ from top edge 58. Distances $d_1$, $d_2$, $d_3$, and $d_4$ are substantially equal, although distances $d_1$, $d_2$, $d_3$ and/or $d_4$ may be other than equal. Further, in the exemplary embodiment, notches 302, 304, 306, and 308 are substantially rectangular-shaped and congruent to each other. More specifically, each notch 302, 304, 306, and 308 has a height $H_3$. Alternatively, notch 302, 304, 306, and/or 308 may have a height other than height $H_3$.

First top side panel 114 includes a first handle flap 310, and second top side panel 120 includes a second handle flap 312. Each handle flap 310 and 312 is substantially rectangular-shaped to correspond to notches 302, 304, 306, and 308 and is defined a distance $d_5$ from a respective fold line 116 or 122. Distance $d_5$ is substantially equal to distances $d_1$, $d_2$, $d_3$, and $d_4$. Further, each handle flap 310 and 312 is defined by a pair of parallel cut lines 314 and 316 and a hinge line 318. Hinge lines 318 each include a pair of parallel fold lines 320 and 322 that are spaced to enable handle flaps 310 and 312 to fold about side panels 50 and 78 or 68 and 88, as described in more detail below.

FIG. 5 is a side perspective view of container 400 formed from blank 300. Container 400 is essentially similar to container 200 (shown in FIGS. 2 and 3), and, as such, similar components are labeled with similar references. Container 400 is formed from blank 300 using a method similar to the method used to form container 200 from blank 10, as described above. Further, container 400 may be formed with a machine that performs the method of constructing container 400. As shown in FIG. 5, first and third side panels 50 and 78 and second and fourth side panels 68 and 88 do not overlap and, as such, side panels 50 and 78 and side panels 68 and 88 are not secured to each other. Alternatively, side panels 50 and 78 and/or side panels 68 and 88 overlap as described with respect to container 200 and, as such, are secured as described above.

When first and third side panels 50 and 78 form first side wall 220, first and third notches 302 and 306 define a first handle opening. More specifically, notches 302 and 306 are substantially aligned with each other to form the handle opening. Similarly, when second and fourth side panels 68 and 88 form second side wall 222, second and fourth notches 304 and 308 define a second handle opening 402. More specifically, notches 304 and 308 are substantially aligned with each other to form opening 402. When top side panels 114 and 120 are secured to a respective side wall 220 or 222, handle flap 310 is rotated about hinge line 318 toward cavity 224 at least partially into the respective handle opening, and handle flap 312 is rotated about hinge line 318 toward cavity 224 at least partially into handle opening 402. Hinge lines 318 form a top surface of a handle formed by handle flaps 310 and 312 within the respective handle openings. As such, the handle openings and handle flaps 310 and 312 enable container 400 to be lifted and carried more easily.

The above-described blank and container formed from the blank includes eight sides to provided added compression strength as compared to containers having less than eight sides, such as containers having four sides. Furthermore, the above-described container may be formed about products to be container therein such that, when the container is formed from the blank, the products are loaded and secured into the container. As such, the container is formed and loaded in one process, and once the container is formed it may be transported with the products therein. Moreover, the above-described blank may be formed on a known blank-forming machine. Additionally, the above-described blank includes fifteen fold lines and seventeen panels. As such, fewer steps are required to form the container from the blank, as compared to known polygonal containers.

The above-described side and corner walls are substantially the same height as the front and rear walls such that the side and corner walls provide improved stacking strength and side wall strength as compared to containers having side walls that are shorter than the front and/or rear walls.

Figure 6:
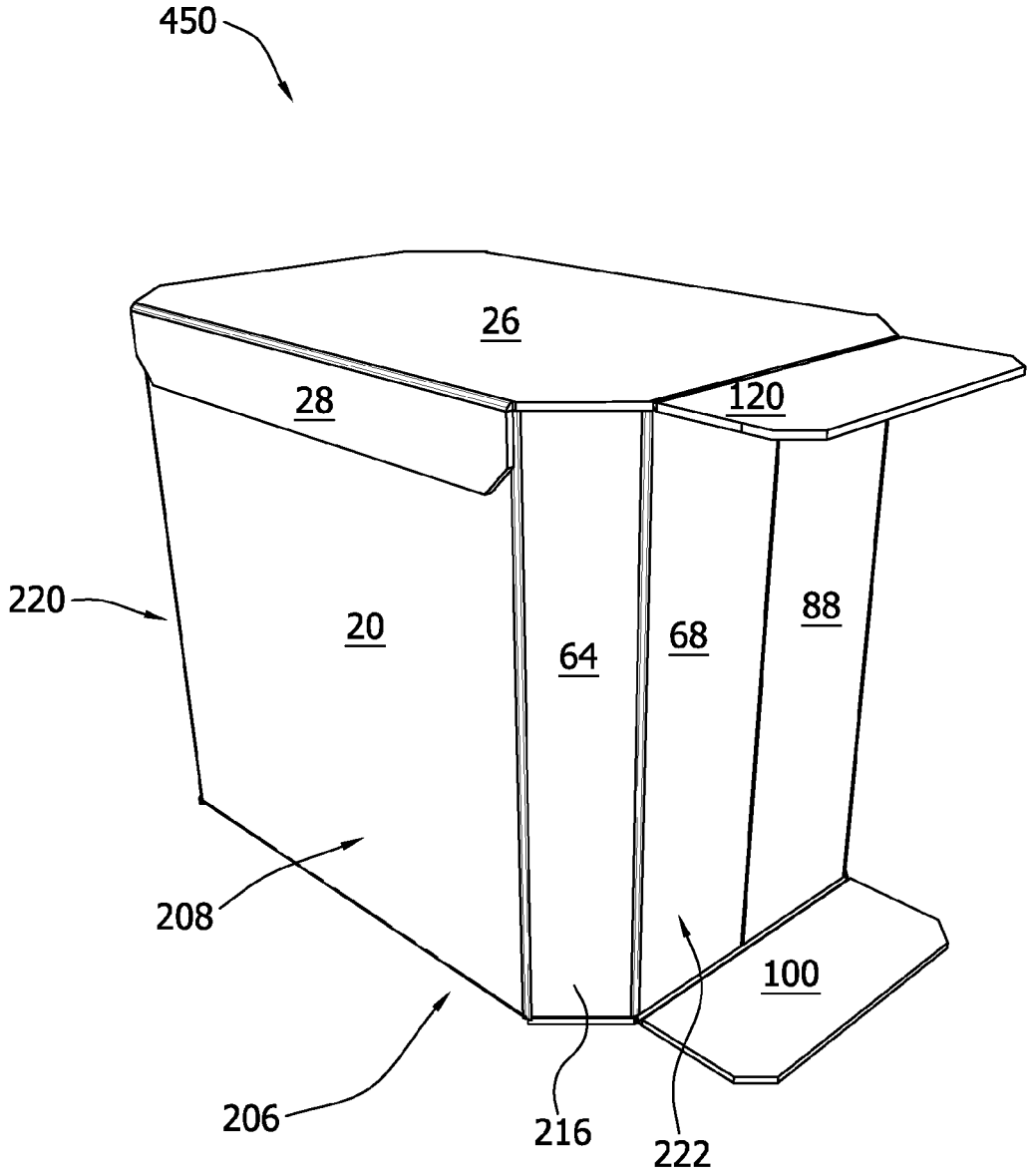
FIG. 6 is a side perspective view of a second alternative embodiment of the present invention similar to the container shown in FIG. 5.

In a second alternative embodiment, FIG. 6 shows a container 450 that is similar to container 400 (FIG. 5) but does not include notches 302, 304, 306 and 308, nor does it include handle flaps 310 and 312. Rather, container 450 includes corresponding side panels 50 and 78 each extending from an adjacent corner panel to a free end wherein the free end of side panel 50 is adjacent to the free end of side panel 78 when the container is erected but the side panels do not overlap. Similarly, side panels 68 and 88 each extend from an adjacent corner panel to a free end wherein the free end of side panel 68 is adjacent to the free end of side panel 88 when the container is erected but the side panels do not overlap.

The above-described side and corner walls are substantially the same height as the front and rear walls such that the side and corner walls provide improved stacking strength and side wall strength as compared to containers having side walls that are shorter than the front and/or rear walls.

Figure 7:
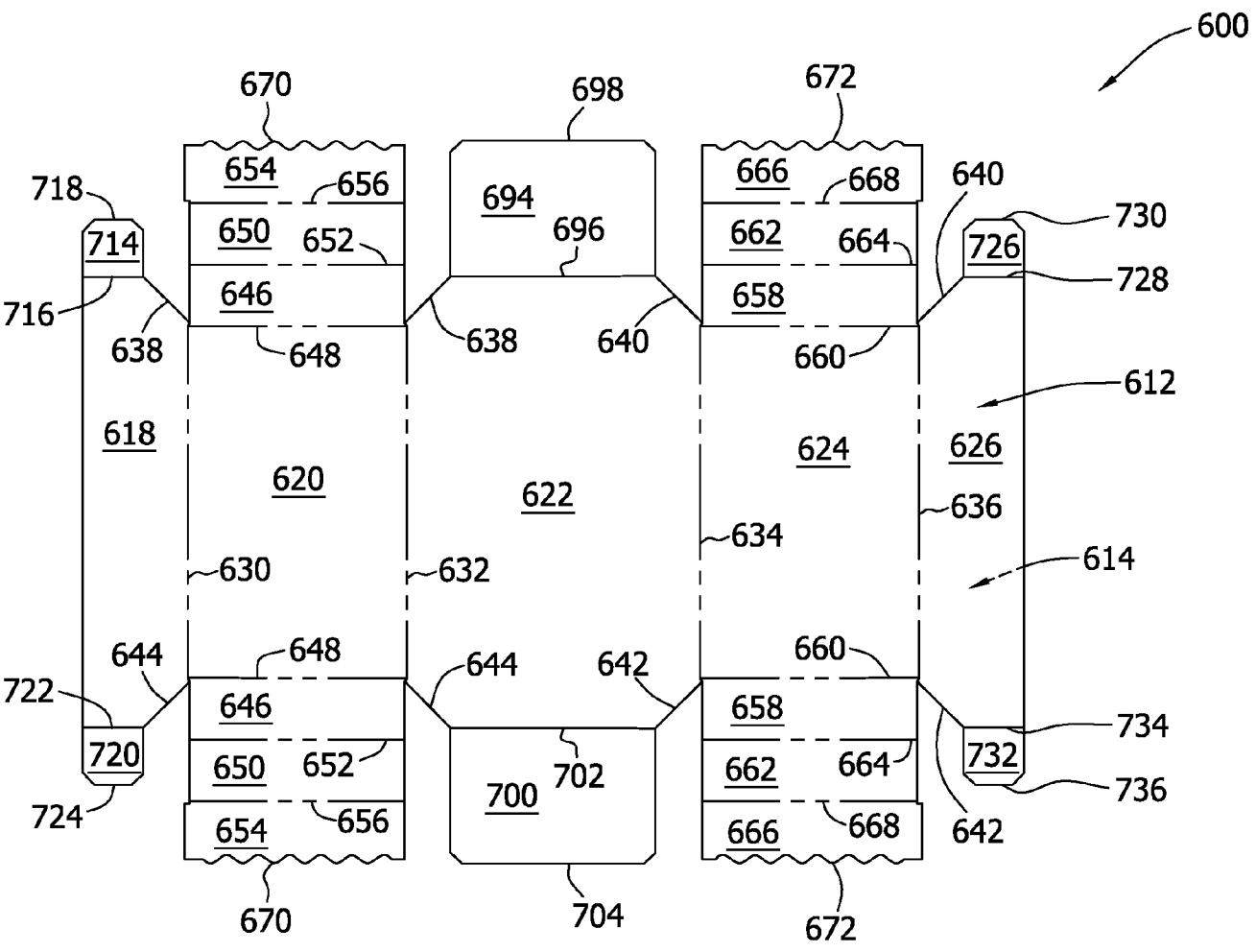
FIG. 7 is a top plan view of a blank of sheet material for constructing a container, according to a third alternative embodiment of the present invention.
Figure 8:
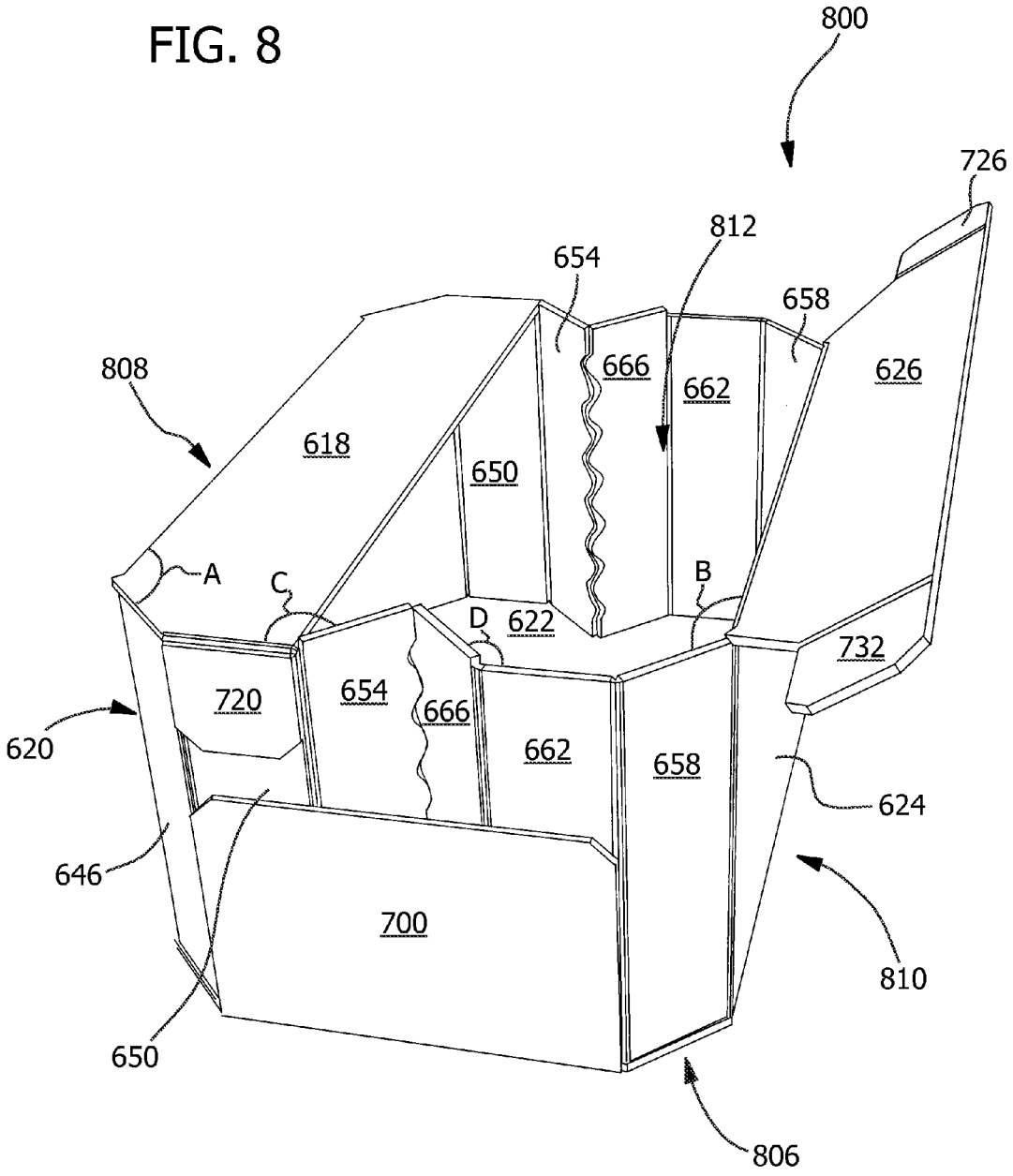
FIG. 8 is a side perspective view of a container formed from the blank shown in FIG. 7.

FIG. 7 is a top plan view of a third alternative embodiment of a blank 600 of sheet material for constructing a container 800 (shown in FIG. 8). Blank 600 includes several components that are similar to components indicated in blank 10 (shown in FIG. 1) and blank 300 (shown in FIG. 4).

Referring now to FIG. 7, which is a top plan view of a third alternative embodiment of a blank 600 of sheet material. A container 800 (shown in FIG. 8) is formed from blank 600. Blank 600 has a first or interior surface 612 and an opposing second or exterior surface 614. Further, blank 600 includes a first top panel 618, a front panel 620, a bottom panel 622, a rear panel 624, and a second top panel 626 coupled together along preformed, generally parallel, fold lines 630, 632, 634, and 636, respectively. More specifically, first top panel 618 extends from fold line 630, front panel 620 extends from first top panel 618 along fold line 630, bottom panel 622 extends from front panel 620 along fold line 632, rear panel 624 extends from bottom panel 622 along fold line 634, and second top panel 626 extends from rear panel 624 along fold line 636. Fold lines 630, 632, 634, and/or 636, as well as other fold lines and/or hinge lines described herein, may include any suitable line of weakening and/or line of separation known to those skilled in the art and guided by the teachings herein provided. Front and rear panels 620 and 624 may be considered to be end panels. When container 800 is formed from blank 600, fold line 630 defines a top edge of front panel 620, fold line 632 defines a bottom edge of front panel 620 and a front edge of bottom panel 622, fold line 634 defines a rear edge of bottom panel 622 and a bottom edge of rear panel 624, fold line 636 defines a top edge of rear panel 624.

Front panel 620 and rear panel 624 are substantially congruent and have a rectangular shape. Bottom panel 622 forms an octagonal shape. Top panels 618 and 626 are also configured to form in combination at least a portion of a substantially octagonal shape.

In the exemplary embodiment, bottom panel 622 may be considered to be substantially rectangular in shape with four cut-off or angled corners 638, 640, 642, and 644. Similarly, top panels 618 and 626, in combination, may be considered to be substantially rectangular in shape with four corresponding cut-off or angled corners 638, 640, 642, and 644. As such, the cut-off corners of otherwise rectangular bottom panel 622 and the combination of top panels 618 and 626 define a generally octagonal shaped container. Moreover, each angled corner 638, 640, 642, and 644 defines a top and bottom end of a corner wall of the container described in greater detail below. Alternatively, bottom panel 622 and/or top panels 618 and 626 have any suitable shape that enable container 800 to function as described herein.

Blank 600 also includes a first pair of corner panels 646 extending from opposing sides of front panel 620 along a fold line 648, a first pair of side panels 650 extending from each corner panel 646 along a fold line 652, and a first pair of joinder panels 654 extending from each side panel 650 along a fold line 656. Similarly, blank 600 includes a second pair of corner panels 658 extending from opposing sides of rear panel 624 along a fold line 660, a second pair of side panels 662 extending from each corner panel 658 along a fold line 664, and a second pair of joinder panels 666 extending from each side panel 662 along a fold line 668. In addition, each of first pair of joinder panels 654 includes a wavy or saw-tooth free edge 670, and each of second pair of joinder panels 666 includes a wavy or saw-tooth free edge 672. As described below in detail, each free edge 670 of joinder panels 654 is configured to engage or interconnect with the corresponding free edge 672 of joinder panels 666.

A first bottom side panel 694 extends from bottom panel 622 along a fold line 696 to a free edge 698, and a second bottom side panel 700 extends from bottom panel 622 along a fold line 702 to a free edge 704. Fold line 696 defines a bottom edge of first bottom side panel 694 and a side edge of bottom panel 622, and fold line 702 defines a bottom edge of second bottom side panel 700 and a side edge of bottom panel 622. First and second bottom side panels 694 and 700 are each generally rectangularly shaped and have angled corners and free side edges.

Similarly, a first top side panel 714 extends from first top panel 618 along a fold line 716 to a free edge 718, and a second top side panel 720 extends from first top panel 618 along a fold line 722 to a free edge 724. A third top side panel 726 extends from second top panel 626 along a fold line 728 to a free edge 730, and a fourth top side panel 732 extends from second top panel 626 along a fold line 734 to a free edge 736.

FIG. 8 is a side perspective view of container 800 that is formed from blank 600 in a partially erected condition. Although container 800 may be formed about a product to be contained therein, container 800 may also be formed without having a product already stored therein. Further, although container 800 may include a plurality of products, container 800 may include any suitable number of products, such as one product. Moreover, products contained within container 800 may have any suitable shape.

To construct container 800 from blank 600, at least one product may be positioned on interior surface 612 of bottom panel 622. In the exemplary embodiment, bottom panel 622 is sized to correspond to product(s) contained within container 800. Front panel 620 is rotated about fold line 632 toward interior surface 12 and/or the products, and rear panel 624 is rotated about fold line 634 toward interior surface 612 and/or the products. More specifically, front panel 620 and rear panel 624 are rotated to be substantially perpendicular to bottom panel 622. When container 800 is formed about the products, interior surface 612 of front and rear panels 620 and 624 is adjacent the side walls of the products. Bottom panel 622 forms a bottom wall 806 of container, front panel 620 forms a front wall 808 of container 800, and rear panel 624 forms a rear wall 810 of container 800.

Each of first corner panels 646 is rotated about fold line 648 toward interior surface 612 and/or the products, and each of first side panels 650 is rotated about fold line 652 toward interior surface 612 and/or the products. More specifically, each of first corner panels 646 and each of first side panels 650 are rotated such that each first corner panel 646 is oriented at an oblique angle A to front panel 620 and each first side panel 650 is substantially perpendicular to front panel 620 and bottom panel 622. Similarly, each of second corner panels 658 is rotated about fold line 660 toward interior surface 612 and/or the products, and each of second side panels 662 is rotated about fold line 664 toward interior surface 612 and/or the products. More specifically, each of second corner panels 658 and each of second side panels 662 are rotated such that each second corner panel 658 is oriented at an oblique angle B to rear panel 624 and each second side panel 662 is substantially perpendicular to rear panel 624 and bottom panel 622. In the exemplary embodiment, angles A and B are substantially equal, however, angles A and B can be other than equal depending on the products contained within container 800.

Each of first pair of joinder panels 654 is rotated about fold line 656 toward interior surface 612, and each of second pair of joinder panels 666 is rotated about fold line 668 such that each free edge 670 of first joinder panels 654 engages or is interconnected with the corresponding free edge 672 of second joinder panels 666. More specifically, each of first joinder panels 654 are rotated such that each first joinder panel 654 is oriented at an oblique angle C to each corresponding first side panel 650, and each of second joinder panels 666 are rotated such that each second joinder panel 666 is oriented at an oblique angle D to each corresponding second side panel 662.

First bottom side panel 694 is rotated substantially perpendicular to bottom panel 622 about fold line 696 and is attached to side panels 650 and 662. Second bottom side panel 700 is rotated substantially perpendicular to bottom panel 622 about fold line 702 and is attached to side panels 650 and 662. First bottom side panel 694 and second bottom side panel 700 do not overlap either first or second pairs of corner panels 646 and 658.

To close container 800, first top panel 618 is rotated about fold line 630 and second top panel 626 is rotated about fold line 636 toward cavity 812 such that first and second top panels 618 and 626 are substantially perpendicular to front wall 808 and rear wall 810, and substantially parallel to bottom wall 806. First top side panel 714 is rotated about fold line 716 toward exterior surface 614 and attached to the corresponding side panel of the first pair of side panels 650. Second top side panel 720 is rotated about fold line 722 toward exterior surface 614 and attached to the corresponding side panel of the first pair of side panels 650.

Third top side panel 726 is rotated about fold line 728 toward exterior surface 614 and attached to the corresponding side panel of the second pair of side panels 662. Fourth top side panel 732 is rotated about fold line 734 toward exterior surface 614 and attached to the corresponding side panel of the second pair of side panels 662. In the example embodiment, first and second top panels 618 and 626 do not cover the entire top area of cavity 812, rather top panels 618 and 626 cover a portion of the top area of cavity 812 by leaving a gap between side free edges of the top panels. In another embodiment, top panels 618 and 626 cover the entire top area of cavity 812.

The above-described method to construct container 800 from blank 600 may be performed using a machine. The machine performs the above-described method to continuously form container 800 from blank 600 as blank 600 is moved though the machine.

Figure 9:
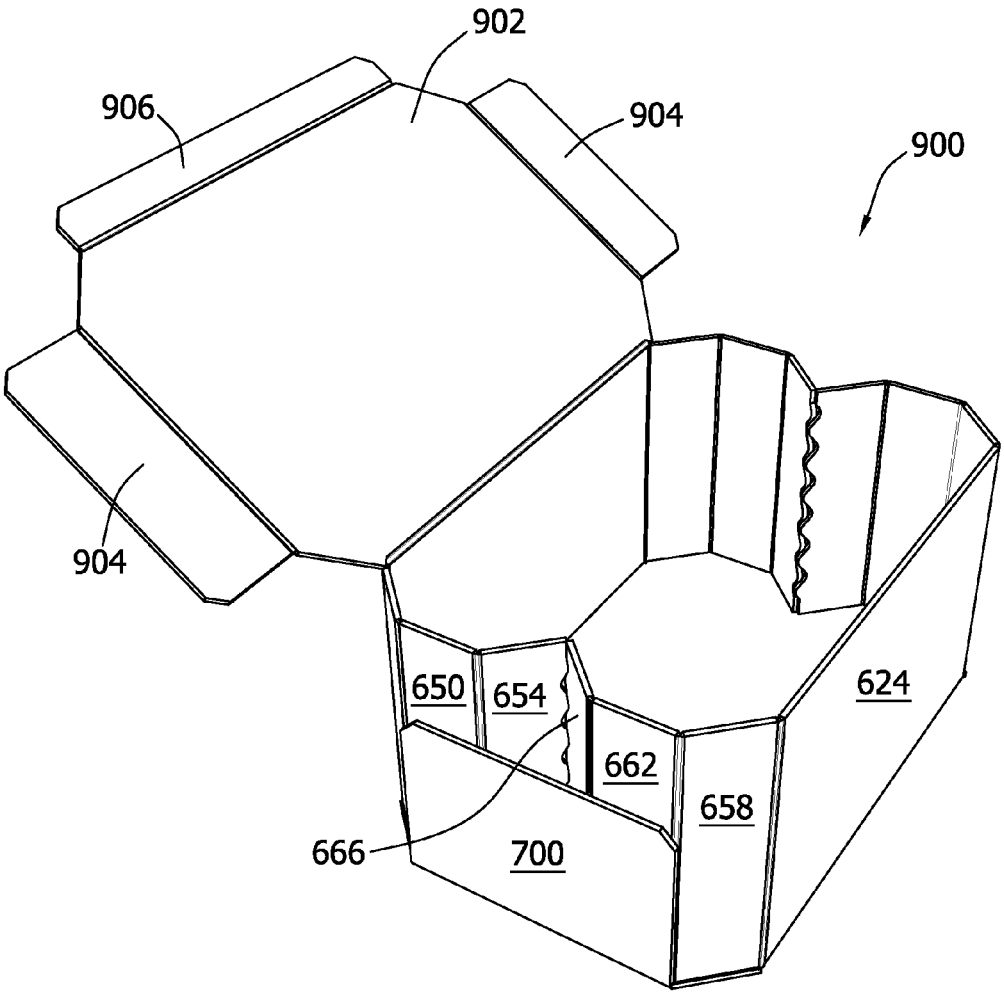
FIG. 9 is a side perspective view of a fourth alternative embodiment of the present invention similar to the container shown in FIG. 8.

FIG. 9 is a side perspective view of a fourth alternative embodiment of the present invention similar to the container shown in FIG. 8. FIG. 9 shows a container 900 that is similar to the container shown in FIG. 8 except container 900 includes a different top panel structure. For example, container 900 includes a top panel 902 with side closure flaps 904 and end closure flap 906. The closure flaps are affixed to the end and side walls when the container is sealed shut.

Exemplary embodiments of a container formed about a product to be contained therein and blanks for making the same are described above in detail. The blanks and the container are not limited to the specific embodiments described herein, but rather, components of the blanks and/or the container may be utilized independently and separately from other components described herein. For example, the blanks may also be used in combination with other type of product, and is not limited to practice with only the cylindrical products, as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blank of sheet material for forming a container, said blank comprising:

a front panel, a bottom panel, a rear panel, and a top panel connected in series along a plurality of substantially parallel fold lines, each of said front, bottom, rear, and top panels including a pair of opposing side edges that are substantially perpendicular to said substantially parallel fold lines;

a corner panel extending from each said side edge of each of said front and rear panels, each said corner panel including a top edge, an opposing bottom edge, and a height defined therebetween such that, when the container is formed, each of said top and bottom edges is adjacent to and in face-to-face relationship with an interior surface of said top panel and an interior surface of said bottom panel, respectively;

a side panel extending from a side edge of each said corner panel; and a lateral flap extending from each said side edge of each of said top and bottom panels.

2. A blank in accordance with claim 1, wherein each said side panel includes a top edge, an opposing bottom edge, and a substantially constant height defined therebetween.

3. A blank in accordance with claim 1, wherein each said side panel comprises a notch defined within a free edge thereof.

4. A blank in accordance with claim 3, wherein each said lateral flap extending from said top panel includes a handle flap configured to at least partially align with two of said notches when the container is formed.

5. A blank in accordance with claim 1, wherein each said lateral flap includes a pair of opposing free side edges and a depth defined therebetween.

6. A blank in accordance with claim 5, wherein each said side panel has a width that is substantially greater than half the depth.

7. A blank in accordance with claim 5, wherein each said side panel has a width that is substantially equal to half the depth.

8. A blank in accordance with claim 5, wherein each said side panel has a width that is substantially less than half the depth.

9. A container formed from a blank of sheet material, said container comprising:

a front wall, a bottom wall emanating from said front wall along a first fold line, a rear wall opposite said front wall and emanating from said bottom wall along a second fold line, and a top wall opposite said bottom wall and emanating from said rear wall along a third fold line, each of said front, bottom, rear, and top walls including a pair of opposing side edges that are substantially perpendicular to said first, second, and third fold lines;

a plurality of corner walls, each said corner wall emanating from one of said side edges of one of said front and rear walls, each said corner wall including a top edge and an opposing bottom edge, each of said top and bottom edges is adjacent to and in face-to-face relationship with an interior surface of said top wall and an interior surface of said bottom wall, respectively; and a pair of opposing side walls, each said side wall including a pair of side panels and a pair of lateral flaps, each said side panel emanating from a side edge of one of said corner walls, each said lateral flap emanating from one of said side edges of one of said top and bottom walls.

10. A container in accordance with claim 9, wherein each said side panel includes a top edge, an opposing bottom edge, and a substantially constant height defined therebetween.

11. A container in accordance with claim 9, wherein each said side panel comprises a notch defined within a free edge thereof.

12. A container in accordance with claim 11, wherein each said lateral flap emanating from said top panel includes a handle flap at least partially aligned with two of said notches.

13. A container in accordance with claim 9, wherein each said lateral flap includes a pair of opposing free side edges and a depth defined therebetween.

14. A container in accordance with claim 13, wherein each said side panel has a width that is substantially greater than half the depth, such that each said pair of side panels is positioned in a substantially overlapping relationship.

15. A container in accordance with claim 13, wherein each said side panel has a width that is substantially equal to half the depth, such that a free side edge of a first of said pair of side panels is positioned in close proximity to a free side edge of a second of said pair of side panels.

16. A container in accordance with claim 13, wherein each said side panel has a width that is substantially less than half the depth, such that a gap is defined between a free side edge of a first of said pair of side panels and a free side edge of a second of said pair of side panels.

17. A method of forming a container from a blank of sheet material, the blank including a front panel, a bottom panel, a rear panel, and a top panel connected in series along a plurality of substantially parallel fold lines, wherein each of the front, bottom, rear, and top panels includes a pair of opposing side edges that are substantially perpendicular to the substantially parallel fold lines, the blank further including a corner panel extending from each side edge of each of the front and rear panels, a side panel extending from a side edge of each corner panel, and a lateral flap extending from each side edge of each of the top and bottom panels, said method comprising:

rotating the front and rear panels about respective ones of the plurality of substantially parallel fold lines toward an interior surface of the bottom panel to form opposing front and rear walls and a bottom wall;

rotating each corner panel toward an interior surface of an adjacent one of the front and rear panels to form a plurality of corner walls, wherein each corner wall includes a top edge and an opposing bottom edge;

rotating each side panel toward an interior surface of an adjacent one of the corner panels;

rotating the top panel toward the interior surface of the rear panel to form a top wall, wherein each of the top and bottom edges of the corner walls is adjacent to and in face-to-face relationship with an interior surface of the top panel and the interior surface of the bottom panel, respectively; and securing each lateral flap to at least one adjacent side panel to form a pair of opposing side walls.

18. A method in accordance with claim 17, wherein each side panel comprises a notch defined within a free edge thereof and each lateral flap extending from the top panel includes a handle flap, said securing each lateral flap to the at least one adjacent side panel further comprises at least partially aligning each handle flap with two of the notches.

19. A method in accordance with claim 17, wherein each lateral flap includes a pair of opposing free side edges and a depth defined therebetween, and wherein each side panel has a width that is substantially greater than half the depth, said rotating each side panel toward the interior surface of the adjacent one of the corner panels further comprises positioning a pair of the side panels in a substantially overlapping relationship.

20. A method in accordance with claim 17, wherein each lateral flap includes a pair of opposing free side edges and a depth defined therebetween, and wherein each side panel has a width that is substantially equal to half the depth, said rotating each side panel toward the interior surface of the adjacent one of the corner panels further comprises positioning a free side edge of a first side panel in close proximity to a free side edge of a second side panel.

21. A method in accordance with claim 17, wherein each lateral flap includes a pair of opposing free side edges and a depth defined therebetween, and wherein each side panel has a width that is substantially less than half the depth, said rotating each side panel toward the interior surface of the adjacent one of the corner panels further comprises positioning a pair of the side panels such that a gap is defined between a free side edge of a first side panel and a free side edge of a second side panel.

* * * * *